US007090334B2

(12) United States Patent
Tomizawa et al.

(10) Patent No.: US 7,090,334 B2
(45) Date of Patent: Aug. 15, 2006

(54) INK JET RECORD HEAD

(75) Inventors: Keiji Tomizawa, Kanagawa (JP); Shuichi Murakami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/140,997

(22) Filed: Jun. 1, 2005

(65) Prior Publication Data

US 2005/0219326 A1 Oct. 6, 2005

Related U.S. Application Data

(62) Division of application No. 10/614,009, filed on Jul. 8, 2003, now Pat. No. 6,984,026.

(30) Foreign Application Priority Data

Jul. 10, 2002 (JP) ..... 2002-201877
Jul. 7, 2003 (JP) ..... 2003-271625

(51) Int. Cl.
*B41J 2/14* (2006.01)
*B41J 2/16* (2006.01)

(52) U.S. Cl. ..... 347/47; 347/63

(58) Field of Classification Search ..... 347/20, 347/44, 47, 56, 61, 63, 65, 67
See application file for complete search history.

(56) References Cited

U.S. PATENT DOCUMENTS

| | | | | |
|---|---|---|---|---|
| 4,209,794 | A * | 6/1980 | Kattner | 347/47 |
| 5,218,376 | A | 6/1993 | Asai | 347/61 |
| 5,451,993 | A * | 9/1995 | Takahashi et al. | 347/47 |
| 5,646,662 | A | 7/1997 | Kitahara | 347/47 |
| 6,113,222 | A * | 9/2000 | Ohkuma | 347/63 |
| 6,137,510 | A | 10/2000 | Sato et al. | 347/63 |
| 6,286,933 | B1 | 9/2001 | Murakami et al. | 347/47 |
| 6,350,016 | B1 | 2/2002 | Tachihara et al. | 347/56 |
| 6,398,348 | B1 | 6/2002 | Haluzak et al. | 347/63 |
| 6,439,696 | B1 | 8/2002 | Murakami et al. | 347/56 |
| 6,443,561 | B1 | 9/2002 | Murakami | 347/61 |
| 6,520,626 | B1 | 2/2003 | Murakami | 347/56 |
| 6,540,335 | B1 | 4/2003 | Touge et al. | 347/65 |
| 6,755,510 | B1 | 6/2004 | Murakami et al. | 347/63 |
| 6,830,317 | B1 | 12/2004 | Tsuchii et al. | 347/56 |
| 2002/0054181 | A1 | 5/2002 | Murakami | 347/19 |
| 2002/0196299 | A1 | 12/2002 | Murakami | 347/12 |
| 2003/0058305 | A1 | 3/2003 | Murakami et al. | 347/47 |
| 2003/0067508 | A1 | 4/2003 | Mizutani et al. | 347/40 |
| 2004/0021744 | A1 | 2/2004 | Murakami et al. | 347/65 |
| 2004/0130598 | A1 | 7/2004 | Tomizawa et al. | 347/61 |

FOREIGN PATENT DOCUMENTS

| | | |
|---|---|---|
| EP | 1 167 471 | 1/2002 |
| EP | 116 747 | 1/2002 |

(Continued)

*Primary Examiner*—Juanita D. Stephens
(74) *Attorney, Agent, or Firm*—Fitzpatrick, Cella, Harper & Scinto

(57) ABSTRACT

An ink jet recording head having a nozzle shape capable of promptly curbing meniscus vibrations occurring on refilling and stably performing discharge is provided. In the ink jet recording head, a second discharge port portion has a form in which, with a lower side of a square on a bubbling chamber side, angles on an upper side of the square are curved respectively on any cross section perpendicular to a principal surface of an element substrate on which heaters are formed and going through the center of a discharge port, and these curves are shaped as arcs of circles of a radius R inscribed in the angles on the upper side of the square respectively.

10 Claims, 6 Drawing Sheets

FOREIGN PATENT DOCUMENTS

| | | |
|---|---|---|
| JP | 54-161935 | 12/1979 |
| JP | 57-107848 | 7/1982 |
| JP | 61-185455 | 8/1986 |
| JP | 61-249768 | 11/1986 |
| JP | 63-183855 | 7/1988 |
| JP | 4-10940 | 1/1992 |
| JP | 4-10941 | 1/1992 |
| JP | 5-177834 | 7/1993 |

* cited by examiner

INK JET RECORD HEAD

This is a divisional application of application Ser. No. 10/614,009, filed on Jul. 8, 2003 now U.S. Pat. No. 6,984,026.

BACKGROUND OF THE INVENTION

1. Field of the Invention

The present invention relates to a liquid discharge head for discharging a liquid droplet such as an ink droplet and performing recording on a recording medium, and in particular, to the liquid discharge head for performing ink jet recording.

2. Related Background Art

An ink jet recording system is one of so-called non-impact recording systems. As for the ink jet recording system, noise generated on recording is almost negligible and high speed recording is possible. The ink jet recording system is capable of recording on various recording media and fixing ink on so-called standard paper without requiring a special process, and in addition, it allows a high-definition image to be obtained at a low price. Because of these advantages, the ink jet recording system is rapidly becoming widespread in recent years not only for a printer as a peripheral of a computer but also as a means of recording of a copying machine, a facsimile, a word processor and so on.

Ink discharge methods of the generally used ink jet recording system include a method of using an electrothermal converting element such as a heater as a discharge energy generating element used for discharging ink droplets and a method of using a piezoelectric element such as a piezo element as the same. Either method can control the discharge of the ink droplets by means of an electrical signal. According to a principle of the ink discharge method using the electrothermal converting element, a voltage is applied to the electrothermal converting element to instantaneously heat the ink in the proximity thereof so as to discharge the ink droplets at high speed by means of an abrupt bubbling pressure generated by phase change of the ink on boiling. On the other hand, according to the principle of the ink discharge method using the piezoelectric element, the voltage is applied to the piezoelectric element to displace it so as to discharge the ink droplets by means of the pressure generated on the displacement.

The ink discharge method using the electrothermal converting element has advantages such as no need to secure large space for placing the discharge energy generating element, a simple structure of a record head and easy integration of nozzles. On the other hand, the problems unique to this ink discharge method include change in volume of a flying ink droplets due to thermal storage of the heat generated by the electrothermal converting element and so on in the record head, an adverse effect caused on the electrothermal converting element by cavitation due to disappearance of bubble, and the adverse effect caused on a discharge characteristic of the ink droplets and image quality by the air melted into the ink becoming remaining bubbles in the record head.

As for the methods of solving these problems, there are the ink jet recording systems and record heads disclosed by Japanese Patent Application Laid-Open No. 54-161935, Japanese Patent Application Laid-Open No. 61-185455, Japanese Patent Application Laid-Open No. 61-249768 and Japanese Patent Application Laid-Open No. 4-10941. To be more specific, the ink jet recording systems disclosed by the above patents laid-open have a structure wherein the electrothermal converting element is driven by a recording signal and the bubbles thereby generated are aerated to the outside air. It is possible, by adopting the ink jet recording systems, to stabilize the volume of the flying ink droplets and discharge a minute amount of the ink droplets at high speed. And it becomes possible, by resolving the cavitation generated on disappearance of the bubbles, to improve durability of the heater so as to easily obtain a further high-definition image. As for the structure for having the bubbles communicate with the outside air in the above patents laid-open, there is a named structure for significantly reducing the shortest distance between the electrothermal converting element for generating the bubbles in the ink and a discharge port which is an opening for discharging the ink compared to the past.

The structure of the record head of this type will be described hereafter. It has an element substrate on which the electrothermal converting element for discharging the ink is provided and a flow path composition substrate (also referred to as a discharge port substrate) joined with the element substrate to constitute flow paths of the ink. The flow path composition substrate has a plurality of nozzles through which the ink flows, a supply chamber for supplying the ink to each of the nozzles, and a plurality of discharge ports which are nozzle end openings for discharging the ink droplets. The nozzle is comprised of a bubbling chamber in which bubbles are generated by the electrothermal converting element and a supply path for supplying the ink to the bubbling chamber. The element substrate has the electrothermal converting element provided to be located in the bubbling chamber. The element substrate also has a supply port provided for supplying the ink to the supply chamber from the rear surface on the opposite side of the principal surface in contact with the flow path composition substrate. And the flow path composition substrate has the discharge ports provided at positions opposed to the electrothermal converting elements on the element substrate.

As for the record head constituted as above, the ink supplied from the supply port into the supply chamber is provided along each nozzle so as to be filled in the bubbling chamber. The ink filled in the bubbling chamber is caused to fly by the bubbles generated due to film boiling by the electrothermal converting element in the direction almost orthogonal to the principal surface of the element substrate so that it is discharged as the ink droplets from the discharge ports.

SUMMARY OF THE INVENTION

Incidentally, as for the record head described above, when discharging the ink, the flow of the ink filled in the bubbling chamber is divided into the discharge port side and the supply path side by the bubbles growing in the bubbling chamber. At that time, a pressure due to bubbling of a fluid slips away to the supply path side, or a pressure loss occurs due to friction with an inner wall of the discharge port. This phenomenon causes adverse effects on discharge, and it tends to become conspicuous as a liquid droplet becomes smaller. To be more specific, as a discharge caliber is rendered smaller in order to make a small liquid droplet, resistance of a first discharge port portion becomes extremely high so that a flow rate in the discharge port direction decreases and the flow rate in the flow path direction increases, resulting in reduced discharge speed of the ink droplet. It is possible, as a means for solving this problem, to provide a second discharge port portion whose cross-sectional area vertical to the flow is larger than the discharge port and thereby to lower the entire flow resistance in the discharge port direction so that bubbling grows with less pressure loss in the discharge port direction. Thus, it is feasible to curb the flow rate slipping away in the flow path direction and prevent the reduction in the discharge speed of the ink droplet.

Incidentally, in recent years, the discharge droplet is increasingly rendered minute in order to implement a higher-quality image. As a minute liquid droplet is discharged, the size of the discharge port becomes smaller. As the size of the discharge port thus becomes smaller, the amount of liquid in the discharge port portion becomes smaller so that the liquid in the discharge port portion during standby is apt to become thicker while no discharge is performed. Discharge characteristics of such a thickened portion vary widely compared to other discharge ports. This phenomenon can be resolved by performing a recovery operation. However, it is not desirable in the case of discharging the above-mentioned minute liquid droplet because a throughput is thereby extremely reduced.

In an uneven portion between the second and first discharge port portions, a stagnant area of the ink having almost no flow speed arises in the flow in the discharge port direction after the bubbling. It is necessary not to expand the stagnant area of the ink when changing the shape of the second discharge port portion for the above reason. It is because such stagnation of the ink may cause variations in discharge volume in the case where the discharge is successively performed at a high frequency.

Thus, to achieve the present invention, the inventors hereof have solved the above-mentioned problem as to the thickening by adopting a structure wherein sufficient liquid is held in the proximity of the discharge port, and they have found the structure of the second discharge port portion having little stagnation and possessing sufficient discharge characteristics when having secured sufficient volume of the second discharge port portion.

In consideration of the problem in the above-mentioned actuality, a first object of the present invention is to provide an ink jet record head having a nozzle shape capable of reducing effects of the thickening of the ink in the discharge port portion during standby, possessing good discharge characteristics, promptly curbing meniscus vibrations occurring on refilling, and stably discharging the ink.

A second object of the present invention is to provide the ink jet record head in the nozzle shape capable of curbing the above-mentioned variations in the discharge volume due to thermal storage of the ink.

To attain the objects, the ink jet record head according to the present invention is the one having a plurality of nozzles through which the liquid flows, a supply chamber for supplying the liquid to each of the nozzles, and a plurality of discharge ports which are nozzle end openings for discharging the liquid droplet, wherein: the above described nozzle has: the flow path composition substrate comprised of the bubbling chamber for having the bubble generated by the discharge energy generating element for generating thermal energy for discharging the liquid droplet; the discharge port portion including the above described discharge ports and communicating between the above described discharge ports and the supply path for supplying the ink to the above described bubbling chamber; and a supply path for supplying the ink to the bubbling chamber; and an element substrate on which the above described discharge energy generating element is provided and joining the above described flow path composition substrate with the principal surface, and the above described discharge port portion has the first discharge port portion of an almost fixed diameter including the above described discharge port and the second discharge port portion following the first discharge port portion and communicating in steps with the above described first discharge port portion and the above described bubbling chamber respectively, and a boundary portion between the above described second discharge port portion and the above described bubbling chamber and the boundary portion between the above described second discharge port portion and the above described first discharge port portion are contiguously formed by a wall having a curvature.

It is possible, by the above-mentioned record head structure, to provide an ink jet head capable of reducing the effects due to the thickening of the ink in the discharge port portion during standby, recording an image having few variations in the discharge characteristics and possessing high definition. It can also curb the meniscus vibrations. To be more specific, when the liquid rushes in the discharge port direction while refilling, a liquid flow close to a wall surface of the above-mentioned second discharge port portion is bent along a curved portion and has a flow rate for colliding almost vertically with a refilling mainstream in a direction vertical to the above described element substrate so that a rush speed into the discharge port of the refilling mainstream in the direction vertical to the above described element substrate is reduced so as to consequently attenuate the meniscus vibrations (refer to FIG. 6, illustrating a schematic sectional view similar to FIGS. 2B, 3B, 4B and 5B).

Furthermore, in the case of successively discharging at the high frequency, the minute stagnant areas of the ink having almost no flow speed become smaller in the flow in the discharge port direction after the bubbling. Consequently, the thermal storage of the ink is held down on successive discharge operations by an electrothermal converting element so that there will be fewer variations in the volume of discharged liquid droplets.

According to the present invention, the second discharge port portion is curved so that the thickness between the surface of a flow path composition member and a ceiling surface of the second discharge port portion is kept relatively thick so as to increase strength.

DESCRIPTION OF THE PREFERRED EMBODIMENTS

Figure 1:
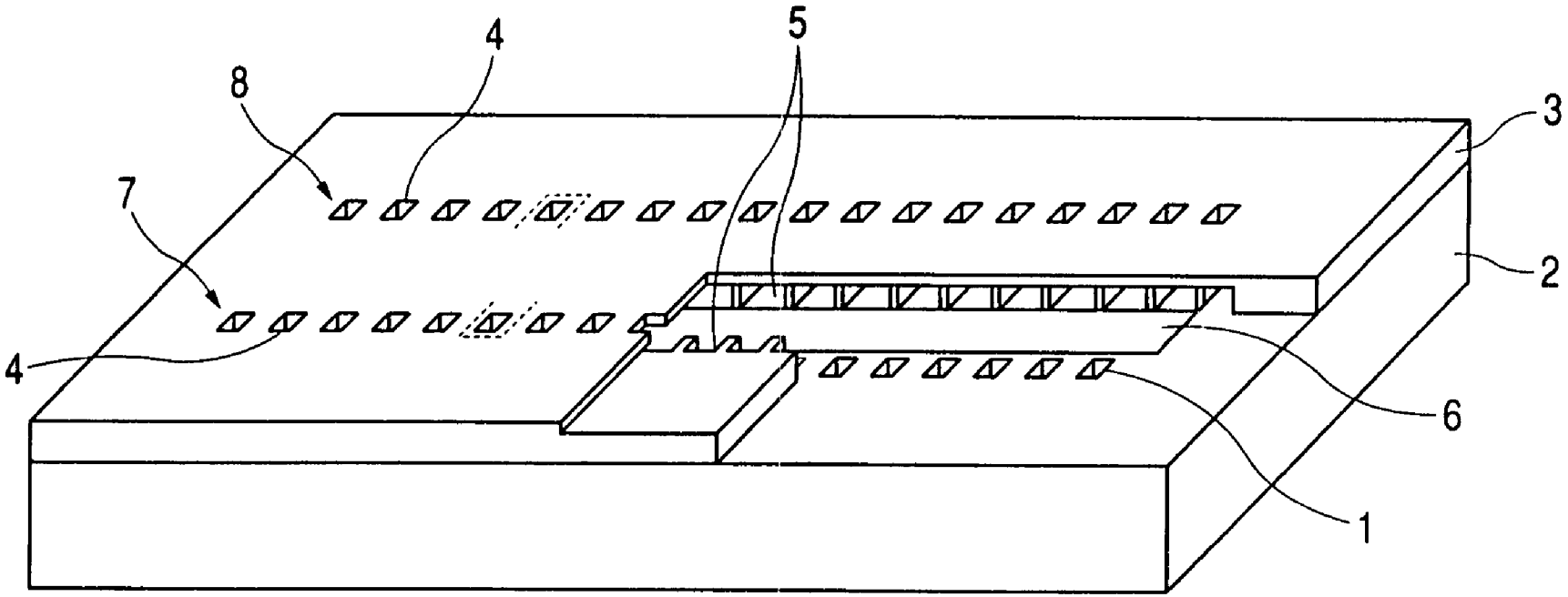
FIG. 1 is a perspective view showing a cutout portion of an embodiment of an ink jet record head suitable for the present invention.

Hereafter, the embodiments of the present invention will be described by referring to the drawings.

An ink jet record head according to the present invention is a record head specifically adopting a system, of the ink jet recording systems, having a means for generating thermal energy as energy utilized for discharging liquid ink and causing a change of state of the ink with the thermal energy. It attains higher density and higher definition of characters and images to be recorded. In particular, according to the present invention, an electrothermal converting element is used as means for generating the thermal energy, and the ink is discharged by utilizing a pressure due to bubbles generated when heating and film-boiling the ink with the electrothermal converting element.

First, an overall structure of the ink jet record head according to this embodiment will be described.

FIG. 1 is a perspective view showing a cutout portion of the embodiment of the ink jet record head suitable for the present invention.

The ink jet record head in the form shown in FIG. 1 has a structure wherein an isolation wall is extendedly placed from a discharge port 4 to the proximity of a supply chamber 6 for the sake of individually and independently forming a nozzle 5 which is a flow path of the ink to each of a plurality of heaters 1 which are the electrothermal converting elements.

The ink jet record head has the plurality of heaters 1 and a plurality of nozzles 5, and is equipped with a first nozzle sequence 7 having the nozzles 5 in a longitudinal direction arranged in parallel and a second nozzle sequence 8 having the nozzles 5 in the longitudinal direction arranged in parallel at positions opposed to the first nozzle sequence 7 across the supply chamber 6.

The first and second nozzle sequences 7 and 8 are formed to have adjacent nozzles at intervals of a 600 dpi pitch. The nozzles 5 in the second nozzle sequence 8 are arranged so that the pitches among the adjacent nozzles are mutually deviated by a ½ pitch against the nozzles 5 in the first nozzle sequence 7.

The above-mentioned record head has an ink discharge means to which the ink jet recording system disclosed in Japanese Patent Application Laid-Open No. 4-10940 and Japanese Patent Application Laid-Open No. 4-10941 is applied, where bubbles generated when discharging the ink communicate with the outside air via the discharge port.

Hereafter, the nozzle structure of the ink jet record head which is a main part of the present invention will be described by taking various form examples.

FIRST EMBODIMENT

Figure 2A:
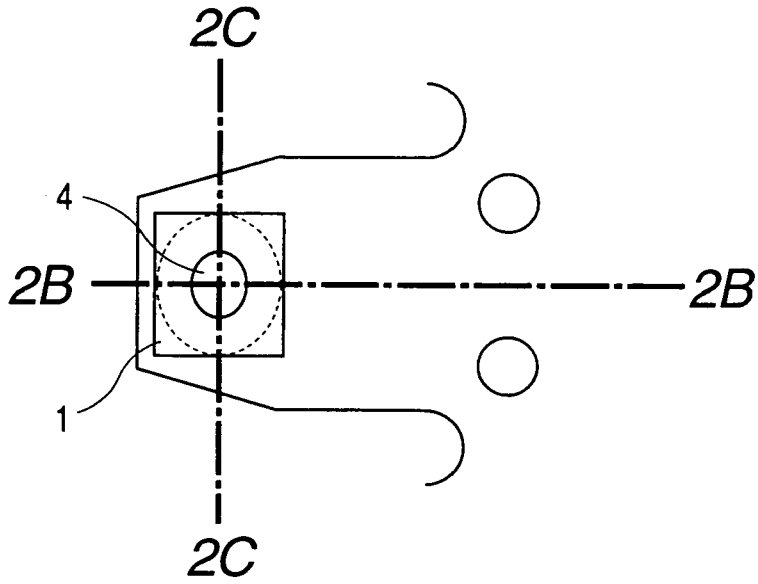
FIGS. 2A, 2B and 2C are diagrams for describing a nozzle structure of the ink jet record head according to a first embodiment of the present invention.
Figure 2B:
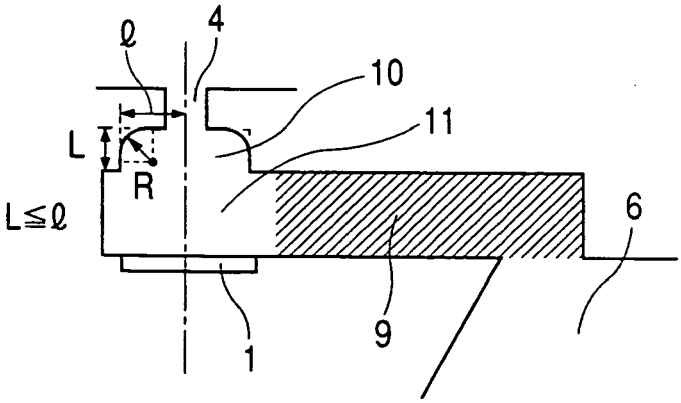
Figure 2C:
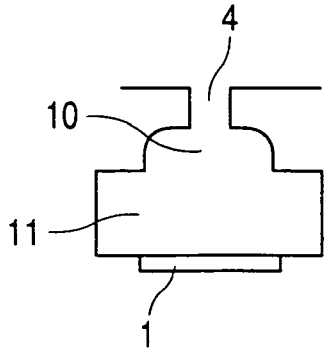

FIGS. 2A, 2B and 2C show the nozzle structure of the ink jet record head according to a first embodiment of the present invention. FIG. 2A is a plan perspective view for viewing one of the plurality of nozzles of the ink jet record head from a vertical direction to a substrate, FIG. 2B is a sectional view along a line 2B—2B in FIG. 2A, and FIG. 2C is a sectional view along a line 2C—2C in FIG. 2A.

As shown in FIG. 1, the record head having the nozzle structure in this form is equipped with an element substrate 2 on which the plurality of heaters 1 which are the electrothermal converting elements are provided and a flow path composition substrate 3 stacked on and joined with a principal surface of the element substrate 2 to constitute a plurality of flow paths of the ink.

The element substrate 2 is formed by glass, ceramics, resin, metal and so on for instance, and is generally formed by Si. On the principal surface of the element substrate 2, the heater 1, an electrode (not shown) for applying a voltage to the heater 1, and wiring (not shown) connected to the electrode are provided in each flow path of the ink in a predetermined wiring pattern respectively. Also on the principal surface of the element substrate 2, a insulation film (not shown) for improving emanation of thermal storage is provided as if to cover the heaters 1. Moreover, on the principal surface of the element substrate 2, a protective film (not shown) for protecting it from cavitation generated when the bubbles disappears is provided as if to cover the insulation film.

As shown in FIG. 1, the flow path composition substrate 3 has the plurality of nozzles 5 through which the ink flows, supply chamber 6 for supplying the ink to each of the nozzles 5 and the plurality of discharge ports 4 which are end openings of the nozzles 5 for discharging the ink droplets. The discharge ports 4 are formed at positions opposed to the heaters 1 on the element substrate 2. As shown in FIG. 2, the nozzle 5 has a first discharge port portion including the discharge port 4, a second discharge port portion 10 for reducing flow resistance, a bubbling chamber 11 and a supply path 9 (shaded area in the drawing). The bubbling chamber 11 has a bottom face opposed to an opening face of the discharge port 4 approximately forming a rectangle formed on the heater 1. The supply path 9 has one end thereof communicating with the bubbling chamber 11 and the other end thereof communicating with the supply chamber 6, where a width of the supply path 9 is straightly formed to be almost equal from the supply chamber 6 to the bubbling chamber 11. The second discharge port portion 10 is successively formed on the bubbling chamber 11. Furthermore, the nozzles 5 is formed by orthogonalizing a discharge direction in which the ink droplets fly from the discharge port 4 and a flow direction of the ink liquid flowing in the supply path 9.

The nozzle 5 shown in FIG. 1 is comprised of the first discharge port portion including the discharge port 4, second discharge port portion 10, bubbling chamber 11 and supply path 9, and has inner wall surfaces opposed to the principal surface of the element substrate 2 formed from the supply chamber 6 to the bubbling chamber 11 in parallel with the principal surface of the element substrate 2 respectively.

As shown in FIG. 2B, the second discharge port portion 10 has a form in which angles on the upper side of a square are curved respectively on any cross section vertical to the principal surface of the above described element substrate and going through the center of the discharge port 4 and these curves are shaped as arcs of circles of a radius R inscribed in the angles on the upper side of the above described square. A lower side opposed to the upper side of the above described square is on the bubbling chamber 11 side.

Furthermore, in the sectional view thereof, a height L in the vertical direction to the principal surface of the above described element substrate of the second discharge port portion 10 is smaller than a length l from a perpendicular line drawn down from the center of the discharge port 4 to the above described element substrate to an outermost circumference of the second discharge port portion 10 in the direction parallel with the principal surface of the above described element substrate.

On any cross section vertical to the principal surface of the above described element substrate and going through the center of the discharge port 4, the second discharge port portion 10 is a symmetric figure congruent with the perpendicular line drawn down from the center of the discharge port 4 to the principal surface of the above described element substrate.

Next, a description will be given based on FIGS. 1 and 2 as to an operation of discharging the ink droplets from the discharge port 4 on the record head constituted as above.

First, the ink supplied to the inside of the supply chamber 6 is supplied to the nozzles 5 of the first nozzle sequence 7 and second nozzle sequence 8 respectively. The ink supplied to each nozzle 5 flows along the supply path 9 so as to be filled in the bubbling chamber 11. The ink filled in the bubbling chamber 11 is caused to fly by a growth pressure of the bubbles generated due to film boiling by the heater 1 in the direction almost orthogonal to the principal surface of the element substrate 2 so that it is discharged as the ink droplets from the discharge port 4. When the ink filled in the bubbling chamber 11 is discharged, a part of it flows to the supply path 9 side due to the pressure of the bubbles generated in the bubbling chamber 11. Here, if the aspect from bubbling to discharge of the nozzle is locally viewed, the pressure of the bubbles generated in the bubbling chamber 11 is immediately conveyed to the second discharge port portion 10, and the ink filled in the bubbling chamber 11 and second discharge port portion 10 moves inside the second discharge port portion 10.

In this case, compared to the record head in the past which does not have the second discharge port portion 10 provided inside the nozzle, the cross section parallel with the principal surface of the element substrate 2, that is, space volume of the second discharge port portion 10 is larger, and so a pressure loss rarely occurs and the ink is well discharged toward the discharge port 4. Thus, it is possible, even if the discharge port at the end of the nozzle becomes smaller and the flow resistance in the discharge port direction becomes higher in the first discharge port portion, to curb reduction in the flow rate in the discharge port direction on discharging so as to prevent reduction in discharge speed of the ink droplets.

Figure 6:
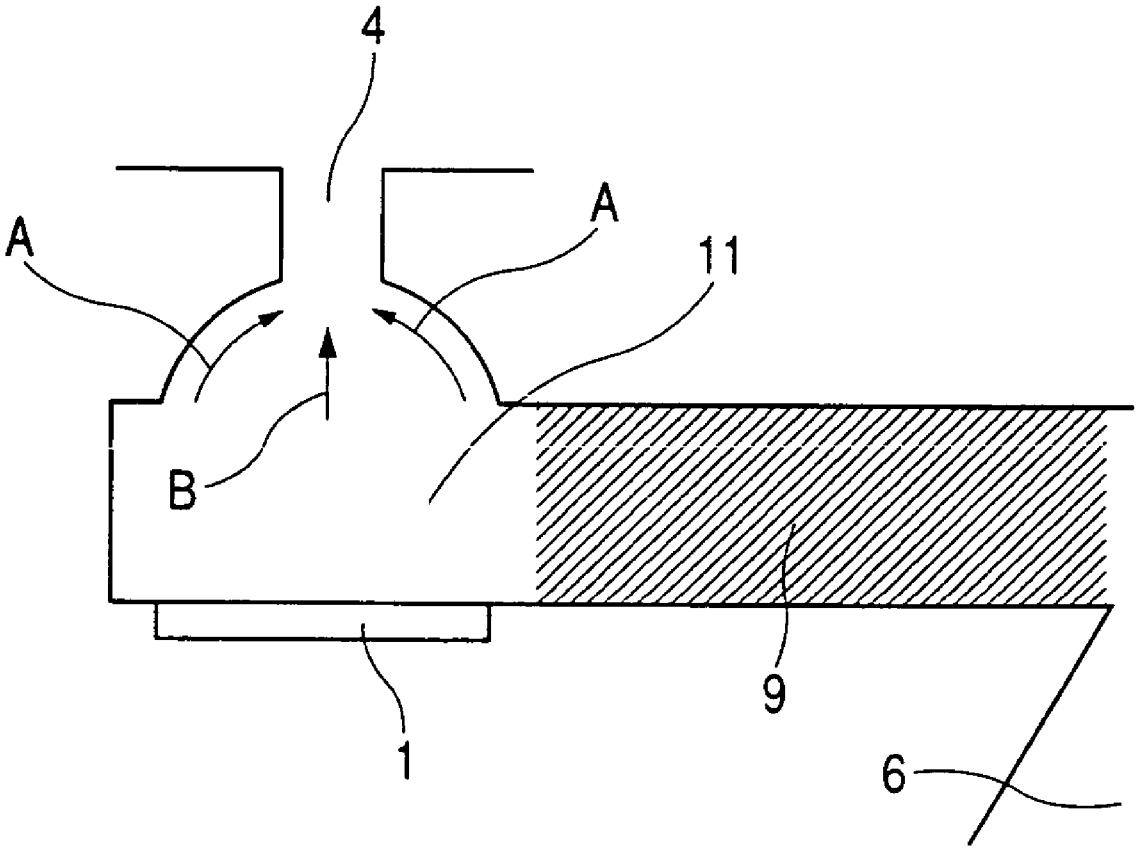
FIG. 6 is a schematic view describing effects of an entraining flow generated on a side of a second discharge port portion according to the first to fourth embodiments of the present invention.

As shown in FIG. 6, if the form as above is adopted, it happens that, on refilling wherein the ink rushes in the discharge port direction due to capillary force after the bubbles communicate with the air, an ink flow close to the wall surface of the above-mentioned second discharge port portion 10 becomes an entraining flow A curved along a curved portion and has a flow speed for almost vertically colliding with a mainstream B of a refill in the vertical direction to the above described element substrate having the heaters 1 formed on its principal surface. Then, it has the effects of reducing the speed of the refill mainstream in the vertical direction to the above described element substrate rushing into the discharge port 4 and attenuating meniscus vibrations.

The first embodiment is also effective on discharge volume fluctuation due to temperature rise in the head. To be more specific, the first embodiment in FIG. 2 has the advantage that, compared to the form of the second discharge port portion in the past (shown by a dashed line in FIG. 2B), the first discharge port portion and second discharge port portion have less stagnant areas of fluid in an uneven portion and less discharge volume fluctuation due to temperature rise.

The record head in the past has a problem that thin areas increase in the thickness between the surface of a flow path composition member on which the discharge port is open and a ceiling surface of the second discharge port portion and so strength in the direction vertical to the principal surface of the element substrate is weak around the discharge port of the flow path composition member. However, the first embodiment also has the advantage that, as the ceiling surface of the second discharge port portion 10 is in a curved shape, the thickness up to the upper part of the discharge port is kept relatively thick and so the strength increases.

SECOND EMBODIMENT

Figure 3A:
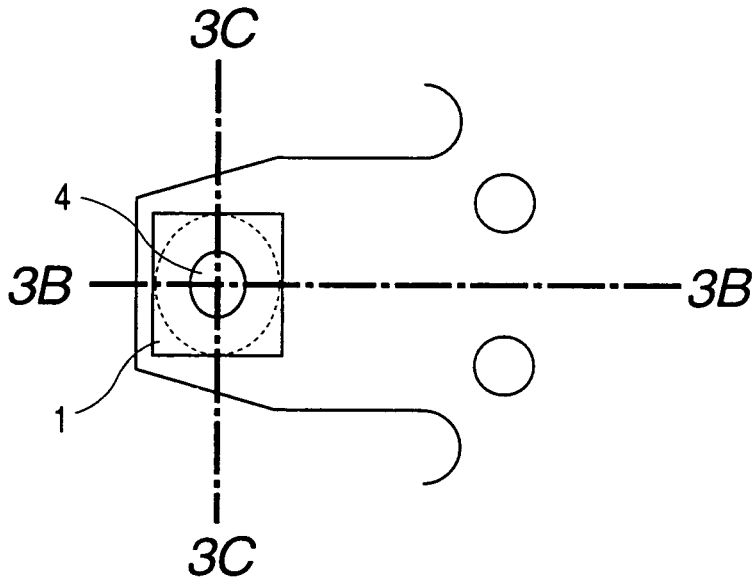
FIGS. 3A, 3B and 3C are diagrams for describing the nozzle structure of the ink jet record head according to a second embodiment of the present invention.
Figure 3B:
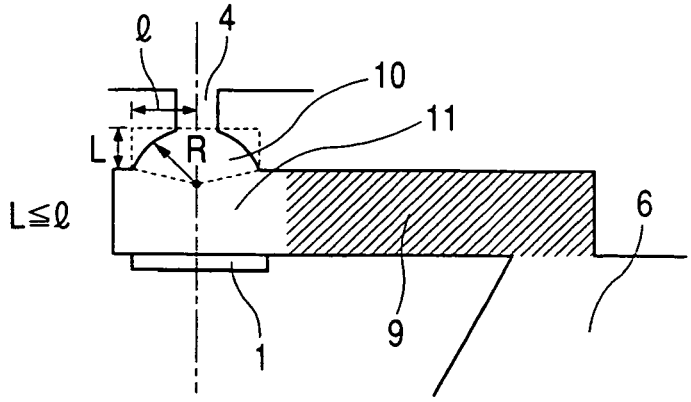
Figure 3C:
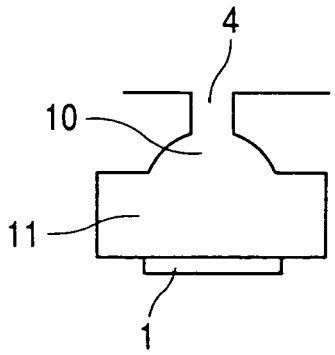

Here, the differences from the first embodiment will be mainly described based on FIGS. 3A, 3B and 3C.

FIGS. 3A, 3B and 3C show the nozzle structure of the ink jet record head according to a second embodiment of the present invention. FIG. 3A is a plan perspective view for viewing one of the plurality of nozzles of the ink jet record head from the vertical direction to the substrate, FIG. 3B is a sectional view along a line 3B—3B in FIG. 3A, and FIG. 3C is a sectional view along a line 3C—3C in FIG. 3A.

As shown in FIG. 3B, the second discharge port portion 10 of the nozzle according to this embodiment has the form in which the angles on the upper side of the square are curved respectively on any cross section vertical to the principal surface of the element substrate (surface on which the heaters 1 are formed) and going through the center of the discharge port 4, and these curves are shaped as arcs of a circle of a radius R having its center on the perpendicular line drawn down from the center of the discharge port 4 to the principal surface of the above described element substrate and going through an intersection point of the perpendicular line and the above described square and the right and left lower ends opened to the bubbling chamber 11 of the second discharge port portion 10. The lower side opposed to the upper side of the above described square is on the bubbling chamber 11 side.

Furthermore, in the sectional view thereof, the height L in the vertical direction to the principal surface of the above described element substrate of the second discharge port portion 10 is smaller than the length l from the perpendicular line drawn down from the center of the discharge port 4 to the above described element substrate to the outermost circumference of the second discharge port portion 10 in the direction parallel with the principal surface of the above described element substrate.

On any cross section vertical to the principal surface of the above described element substrate and going through the center of the discharge port 4, the second discharge port portion 10 is a symmetric figure congruent with the perpendicular line drawn down from the center of the discharge port 4 to the principal surface of the above described element substrate.

Next, a description will be given based on FIGS. 1 and 3 as to the operation of discharging the ink droplets from the discharge port 4 on the record head constituted as above.

First, the ink supplied to the inside of the supply chamber 6 is supplied to the nozzles 5 of the first nozzle sequence 7 and second nozzle sequence 8 respectively. The ink supplied to each nozzle 5 flows along the supply path 9 so as to be filled in the bubbling chamber 11. The ink filled in the bubbling chamber 11 is caused to fly by the growth pressure of the bubbles generated due to film boiling by the heater 1 in the direction almost orthogonal to the principal surface of the element substrate 2 so that it is discharged as the ink droplets from the discharge port 4. When the ink filled in the bubbling chamber 11 is discharged, a part of it flows to the supply path 9 side due to the pressure of the bubbles generated in the bubbling chamber 11. Here, if the aspect from the bubbling to discharge of the nozzle is locally viewed, the pressure of the bubbles generated in the bubbling chamber 11 is immediately conveyed to the second discharge port portion 10, and the ink filled in the bubbling chamber 11 and second discharge port portion 10 moves inside the second discharge port portion 10.

In this case, compared to the record head in the past which does not have the second discharge port portion 10 in the nozzle, the cross section parallel with the principal surface of the element substrate 2, that is, the space volume of the second discharge port portion 10 is larger, and so the pressure loss rarely occurs and the ink is well discharged toward the discharge port 4. Thus, it is possible, even if the discharge port at the end of the nozzle becomes smaller and the flow resistance in the discharge port direction becomes higher in the first discharge port portion, to curb the reduction in the flow rate in the discharge port direction on discharging so as to prevent the reduction in the discharge speed of the ink droplets.

As shown in FIG. 6, if the form as above is adopted, it happens that, on refilling wherein the ink rushes in the discharge port direction due to the capillary force after the bubbles communicate with the air, the ink flow close to the wall surface of the above-mentioned second discharge port portion 10 becomes the entraining flow A curved along the curved portion and has the flow speed for almost vertically colliding with the mainstream B of the refill in the vertical direction to the above described element substrate having the heaters 1 formed on its principal surface. Then, it has the effects of reducing the speed of rushing into the discharge port 4 of the refill mainstream in the vertical direction to the above described element substrate and attenuating the meniscus vibrations.

The second embodiment is also effective on the discharge volume fluctuation due to the temperature rise in the head. To be more specific, compared to the form of the second discharge port portion in the past (shown by a dashed line in FIG. 3B), the second embodiment in FIG. 3 has less stagnant areas of the fluid in the uneven portion in the first discharge port portion and second discharge port portion which are also smaller than the first embodiment, and is more effective in reducing the discharge volume fluctuation due to the temperature rise compared to the first embodiment.

The record head in the past has the problem that the thin areas increase in the thickness between the surface of the flow path composition member on which the discharge port is open and the ceiling surface of the second discharge port portion and so the strength in the direction vertical to the principal surface of the element substrate is weak around the discharge port of the flow path composition member. However, the second embodiment also has the advantage that, as the ceiling surface of the second discharge port portion 10 is in the curved shape, the thickness up to the upper part of the discharge port is kept relatively thick and so the strength increases.

THIRD EMBODIMENT

Figure 4A:
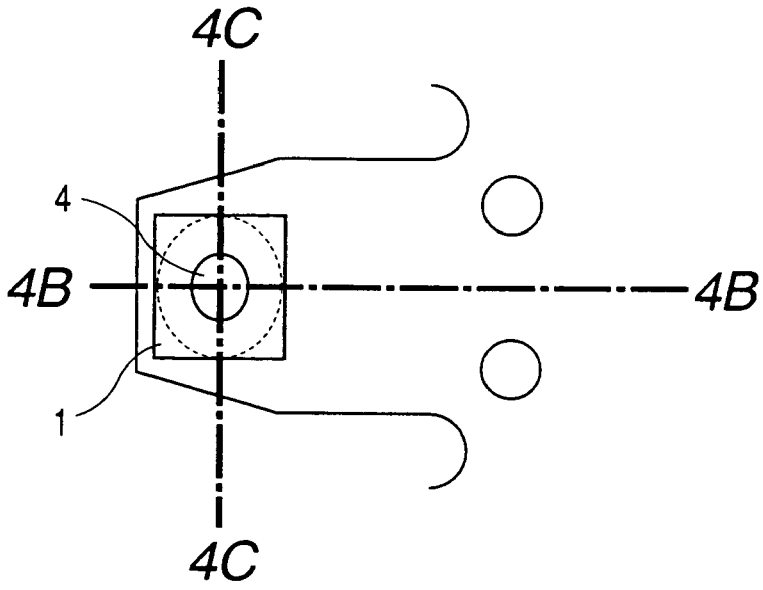
FIGS. 4A, 4B and 4C are diagrams for describing the nozzle structure of the ink jet record head according to a third embodiment of the present invention.
Figure 4B:
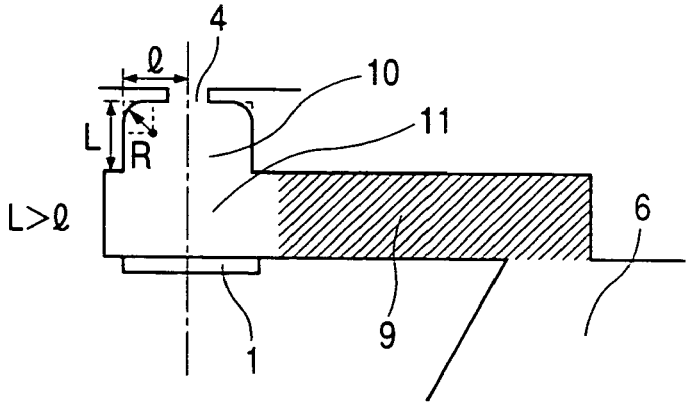
Figure 4C:
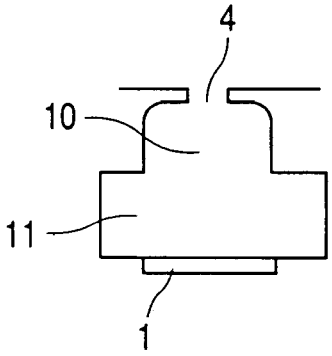

Here, the differences from the first embodiment will be mainly described based on FIGS. 4A, 4B and 4C.

FIGS. 4A, 4B and 4C show the nozzle structure of the ink jet record head according to a third embodiment of the present invention. FIG. 4A is a plan perspective view for viewing one of the plurality of nozzles of the ink jet record head from the vertical direction to the substrate, FIG. 4B is a sectional view along a line 4B—4B in FIG. 4A, and FIG. 4C is a sectional view along a line 4C—4C in FIG. 4A.

As shown in FIG. 4B, the second discharge port portion 10 of the nozzle according to this embodiment has the form in which the angles on the upper side of the square are curved respectively on any cross section vertical to the principal surface of the element substrate (surface on which the heaters 1 are formed) and going through the center of the discharge port 4, and these curves are shaped as arcs of a circle of a radius R inscribed in the angles on the upper side of the square respectively. The lower side opposed to the upper side of the above described square is on the bubbling chamber 11 side.

Furthermore, in the sectional view thereof, as a difference from the first embodiment, the height L in the vertical direction to the principal surface of the above described element substrate of the second discharge port portion 10 is larger than the length l from the perpendicular line drawn down from the center of the discharge port 4 to the above described element substrate to the outermost circumference of the second discharge port portion 10 in the direction parallel with the principal surface of the above described element substrate. On any cross section vertical to the principal surface (surface on which the heaters 1 are formed) of the element substrate and going through the center of the discharge port 4, a lower layer of the second discharge port portion 10 is in a rectangular shape. This embodiment is an effective shape when forward resistance in the discharge port direction is reduced, that is, when the height of a resistance alleviation portion 10 is rendered higher.

On any cross section vertical to the principal surface of the above described element substrate and going through the center of the discharge port 4, the second discharge port portion 10 is the symmetric figure congruent with the perpendicular line drawn down from the center of the discharge port 4 to the principal surface of the above described element substrate.

Next, a description will be given based on FIGS. 1 and 4 as to the operation of discharging the ink droplets from the discharge port 4 on the record head constituted as above.

First, the ink supplied to the inside of the supply chamber 6 is supplied to the nozzles 5 of the first nozzle sequence 7 and second nozzle sequence 8 respectively. The ink supplied to each nozzle 5 flows along the supply path 9 so as to be filled in the bubbling chamber 11. The ink filled in the bubbling chamber 11 is caused to fly by the growth pressure of the bubbles generated due to the film boiling by the heater 1 in the direction almost orthogonal to the principal surface of the element substrate 2 so that it is discharged as the ink droplets from the discharge port 4. When the ink filled in the bubbling chamber 11 is discharged, a part of it flows to the supply path 9 side due to the pressure of the bubbles generated in the bubbling chamber 11. Here, if the aspect from the bubbling to the discharge of the nozzle is locally viewed, the pressure of the bubbles generated in the bubbling chamber 11 is immediately conveyed to the second discharge port portion 10, and the ink filled in the bubbling chamber 11 and second discharge port portion 10 moves inside the second discharge port portion 10.

In this case, compared to the record head in the past which does not have the second discharge port portion 10 in the nozzle, the cross section parallel with the principal surface of the element substrate 2, that is, the space volume of the second discharge port portion 10 is larger, and so the pressure loss rarely occurs and the ink is well discharged toward the discharge port 4. Thus, it is possible, even if the discharge port at the end of the nozzle becomes smaller and the flow resistance in the discharge port direction becomes higher in the first discharge port portion, to curb the reduction in the flow rate in the discharge port direction on discharging so as to prevent the reduction in the discharge speed of the ink droplets.

As shown in FIG. 6, if the form as above is adopted, it happens that, on refilling wherein the ink rushes in the discharge port direction due to the capillary force after the bubbles communicate with the air, the ink flow close to the wall surface of the above-mentioned second discharge port portion 10 becomes the entraining flow A curved along the curved portion and has the flow speed for almost vertically colliding with the mainstream B of the refill in the vertical direction to the above described element substrate having the heaters 1 formed on its principal surface. Then, it has the effects of reducing the speed of rushing into the discharge port 4 of the refill mainstream in the vertical direction to the above described element substrate and attenuating the meniscus vibrations.

The third embodiment is also effective on the discharge volume fluctuation due to the temperature rise in the head. To be more specific, compared to the form of the second discharge port portion in the past (shown by a dashed line in FIG. 4B), the third embodiment in FIG. 4 has the advantage that there are less stagnant areas of the fluid in the uneven portion between the first discharge port portion and second discharge port portion.

The record head in the past has the problem that the thin areas increase in the thickness between the surface of the flow path composition member on which the discharge port is open and the ceiling surface of the second discharge port portion and so the strength in the direction vertical to the principal surface of the element substrate is weak around the discharge port of the flow path composition member. However, the third embodiment also has the advantage that, as the ceiling surface of the second discharge port portion 10 is in the curved shape, the thickness up to the upper part of the discharge port is kept relatively thick and so the strength increases.

FOURTH EMBODIMENT

Figure 5A:
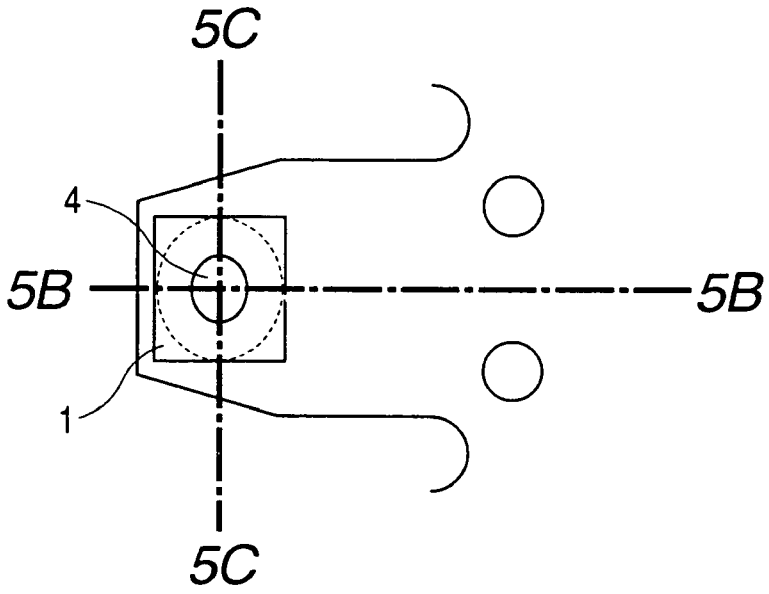
FIGS. 5A, 5B and 5C are diagrams for describing the nozzle structure of the ink jet record head according to a fourth embodiment of the present invention.
Figure 5B:
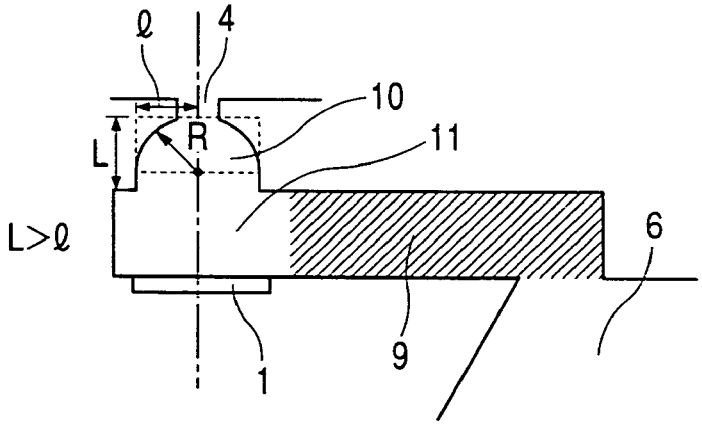
Figure 5C:
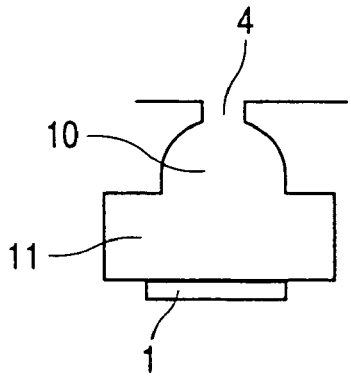

Here, the differences from the first embodiment will be mainly described based on FIGS. 5A, 5B and 5C.

FIGS. 5A, 5B and 5C show the nozzle structure of the ink jet record head according to a fourth embodiment of the present invention. FIG. 5A is a plan perspective view for viewing one of the plurality of nozzles of the ink jet record head from the vertical direction to the substrate, FIG. 5B is a sectional view along a line 5B—5B in FIG. 5A, and FIG. 5C is a sectional view along a line 5C—5C in FIG. 5A.

As shown in FIG. 5B, the second discharge port portion 10 of the nozzle according to this embodiment has the form in which the angles on the upper side of the square are curved respectively on any cross section vertical to the principal surface of the element substrate (surface on which the heaters 1 are formed) and going through the center of the discharge port 4, and these curves are shaped as the arcs of the same circle of a radius R having its center on the perpendicular line drawn down from the center of the discharge port 4 to the principal surface of the above described element substrate and inscribed in the angles on the upper side of the square. The lower side opposed to the upper side of the above described square is on the bubbling chamber 11 side.

Furthermore, in the sectional view thereof, as a difference from the second embodiment, the height L in the vertical direction to the principal surface of the above described element substrate of the second discharge port portion 10 is larger than the length l from the perpendicular line drawn down from the center of the discharge port 4 to the above described element substrate to the outermost circumference of the second discharge port portion 10 in the direction parallel with the principal surface of the above described element substrate. On any cross section vertical to the principal surface (surface on which the heaters 1 are formed) of the element substrate and going through the center of the discharge port 4, the lower layer of the second discharge port portion 10 is in the rectangular shape. This embodiment is the effective shape when the forward resistance in the discharge port direction is reduced, that is, when the height of the resistance alleviation portion 10 is rendered higher.

On any cross section vertical to the principal surface of the above described element substrate and going through the center of the discharge port 4, the second discharge port portion 10 is the symmetric figure congruent with the perpendicular line drawn down from the center of the discharge port 4 to the principal surface of the above described element substrate.

Next, a description will be given based on FIGS. 1 and 5 as to the operation of discharging the ink droplets from the discharge port 4 on the record head constituted as above.

First, the, ink supplied to the inside of the supply chamber 6 is supplied to the nozzles 5 of the first nozzle sequence 7 and second nozzle sequence 8 respectively. The ink supplied to each nozzle 5 flows along the supply path 9 so as to be filled in the bubbling chamber 11. The ink filled in the bubbling chamber 11 is caused to fly by the growth pressure of the bubbles generated due to the film boiling by the heater 1 in the direction almost orthogonal to the principal surface of the element substrate 2 so that it is discharged as the ink droplets from the discharge port 4. When the ink filled in the bubbling chamber 11 is discharged, a part of it flows to the supply path 9 side due to the pressure of the bubbles generated in the bubbling chamber 11. Here, if the aspect from the bubbling to the discharge of the nozzle is locally viewed, the pressure of the bubbles generated in the bubbling chamber 11 is immediately conveyed to the second discharge port portion 10, and the ink filled in the bubbling chamber 11 and second discharge port portion 10 moves inside the second discharge port portion 10.

In this case, compared to the record head in the past which does not have the second discharge port portion 10 in the nozzle, the cross section parallel with the principal surface of the element substrate 2, that is, the space volume of the second discharge port portion 10 is larger, and so the pressure loss rarely occurs and the ink is well discharged toward the discharge port 4. Thus, it is possible, even if the discharge port at the end of the nozzle becomes smaller and the flow resistance in the discharge port direction becomes higher in the first discharge port portion, to curb the reduction in the flow rate in the discharge port direction on discharging so as to prevent the reduction in the discharge speed of the ink droplets.

As shown in FIG. 6, if the form as above is adopted, it happens that, on refilling wherein the ink rushes in the discharge port direction due to the capillary force after the bubbles communicate with the air, the ink flow close to the wall surface of the above-mentioned second discharge port portion 10 becomes the entraining flow A curved along the curved portion and has the flow speed for almost vertically colliding with the mainstream B of the refill in the vertical direction to the above described element substrate having the heaters 1 formed on its principal surface. Then, it has the effects of reducing the speed of rushing into the discharge port 4 of the refill mainstream in the vertical direction to the above described element substrate and attenuating the meniscus vibrations.

The fourth embodiment is also effective on the discharge volume fluctuation due to the temperature rise in the head. To be more specific, compared to the form of the second discharge port portion in the past (shown by a dashed line in FIG. 5B), the fourth embodiment in FIG. 5 has less stagnant areas of the fluid in the uneven portion between the first discharge port portion and second discharge port portion which are also smaller compared to the first and third embodiments, and is more effective at reducing the discharge volume fluctuation due to the temperature rise than the first and third embodiments.

The record head in the past has the problem that the thin areas increase in the thickness between the surface of the flow path composition member on which the discharge port is open and the ceiling surface of the second discharge port portion and so the strength in the direction vertical to the principal surface of the element substrate is weak around the discharge port of the flow path composition member. However, as for the fourth embodiment also has the advantage that, as the ceiling surface of the second discharge port portion 10 is in the curved shape, the thickness up to the upper part of the discharge port is kept relatively thick and so the strength increases.

As described above, as for the ink jet record head according to the present invention, the cross section parallel with the principal surface of the element substrate, that is, the space volume of the second discharge port portion is larger compared to the record head in the past which does not have the second discharge port portion in the nozzle, and so the pressure loss rarely occurs and the ink is well discharged toward the discharge port. Thus, it is possible, even if the discharge port at the end of the nozzle becomes smaller and the flow resistance in the discharge port direction becomes higher in the first discharge port portion, to curb the reduction in the flow rate in the discharge port direction on discharging so as to prevent the reduction in the discharge speed of the ink droplets.

On refilling wherein the ink rushes in the discharge port direction, the ink flow close to the wall surface of the above-mentioned second discharge port portion becomes curved along the curved portion and has the flow speed for almost vertically colliding with the mainstream of the refill in the vertical direction to the above described element substrate. Therefore, the speed of rushing into the first discharge port portion of the refill mainstream in the vertical direction to the above described element substrate is reduced and the meniscus vibrations are consequently attenuated so that it can be safely discharged.

Furthermore, compared to a cylinder-shaped record head of which second discharge port portion in the nozzle is simple, the uneven portion between the first and second discharge port portions is smaller. Therefore, in the case where the discharge is successively performed at a high frequency, the minute stagnant areas of the ink having almost no flow speed become smaller in the flow in the discharge port direction after the bubbling. Consequently, the thermal storage of the ink is held down on successive discharge operations by the electrothermal converting element so that there will be fewer variations in the volume of discharged liquid droplets.

According to the present invention, the second discharge port portion is curved so that the thickness between the surface of the flow path composition member on which the discharge port is open and the ceiling surface of the second discharge port portion is kept relatively thick so as to increase the strength in the vertical direction on the principal surface of the element substrate around the discharge port on the flow path composition member.

What is claimed is:

1. An ink jet record head comprising:

a plurality of nozzles through which liquid flows;

a supply chamber for supplying the liquid to each of the nozzles; and a plurality of discharge ports, which are end openings of the nozzles, respectively, for discharging liquid droplets;

an element substrate on which are provided, in correspondence to said nozzles, discharge energy generating elements for generating thermal energy for discharging the liquid droplets; and a flow path composition substrate joined to a principal surface of said element substrate, wherein each nozzle includes a bubbling chamber in which a bubble is generated by the corresponding discharge energy generating element, a discharge port portion including the respective one of said discharge ports and communicating between said respective discharge port and said bubbling chamber, and a supply path for supplying the ink to said bubbling chamber, wherein said discharge port portion has a first discharge port portion of an almost fixed diameter including said discharge port, and a second discharge port portion contiguous to said first discharge port portion and communicating in steps with said first discharge port portion and said bubbling chamber respectively, wherein said second discharge port portion has a first boundary portion between said second discharge port portion and said bubbling chamber, and a second boundary portion between said second discharge port portion and said first discharge port portion, and wherein said first boundary portion and said second boundary portion are continuously formed by a wall having a curvature.

2. The ink jet record head according to claim 1, wherein said second discharge port portion has a wall perpendicular to the principal surface of said element substrate and contiguous to the wall having said curvature, in the first boundary portion between said second discharge port portion and said bubbling chamber.

3. The ink jet record head according to claim 2, wherein said nozzles are formed so as to orthogonalize a discharge direction in which liquid droplets fly from the discharge ports and a flow direction of the liquid flowing in said supply paths.

4. The ink jet record head according to claim 3, wherein the bubbles generated by said discharge energy generating elements communicate with the outside air by passing through said discharge ports.

5. The ink jet record head according to claim 2, wherein the bubbles generated by said discharge energy generating elements communicate with the outside air by passing through said discharge ports.

6. The ink jet record head according to claim 1, wherein said nozzles are formed so as to orthogonalize a discharge direction in which liquid droplets fly from the discharge ports and a flow direction of the liquid flowing in said supply paths.

7. The ink jet record head according to claim 6, wherein the bubbles generated by said discharge energy generating elements communicate with the outside air by passing through said discharge ports.

8. The ink jet record head according to claim 1, wherein said flow path composition substrate has a first nozzle sequence having nozzles in a longitudinal direction arranged in parallel and a second nozzle sequence having nozzles in the longitudinal direction arranged in parallel at positions opposed to the nozzles of the first nozzle sequence across said supply chamber, respectively, while the nozzles in the second nozzle sequence are arranged so that the pitches between adjacent nozzles are mutually deviated by ½ pitch with respect to the nozzles in the first nozzle sequence.

9. The ink jet record head according to claim 8, wherein the bubbles generated by said discharge energy generating elements communicate with the outside air by passing through said discharge ports.

10. The ink jet record head according to claim 1, wherein the bubbles generated by said discharge energy generating elements communicate with the outside air by passing through said discharge ports.

* * * * *